US006099961A

United States Patent [19]

Del Vecchio et al.

[11] Patent Number: 6,099,961

[45] Date of Patent: Aug. 8, 2000

[54] SYNTHETIC CABLE PROVIDED WITH PROTECTION AGAINST SOIL INGRESS

[75] Inventors: Cesar José Moraes Del Vecchio, Village Pendotiba; Adolfo Tsuyoshi Komura, Macaé, both of Brazil

[73] Assignee: Petroleo Brasileiro S.A.-Petrobras, Rio de Janeiro, Brazil

[21] Appl. No.: 09/073,238

[22] Filed: May 6, 1998

[30] Foreign Application Priority Data

May 7, 1997 [BR] Brazil ..... 9703101

[51] Int. Cl.[7] ..... D02G 3/00

[52] U.S. Cl. ..... 428/377; 428/383; 428/373; 427/58; 427/117; 427/118

[58] Field of Search ..... 428/383, 377, 428/373; 427/58, 117, 118; 87/1

[56] References Cited

U.S. PATENT DOCUMENTS

| | | | |
|---|---|---|---|
| 2,737,075 | 3/1956 | Poirier et al. | 87/6 |
| 3,265,809 | 8/1966 | Morieras | 174/121 |
| 3,960,050 | 6/1976 | Eisler . | |
| 4,312,260 | 1/1982 | Morieras | 87/1 |
| 4,534,163 | 8/1985 | Schuerch . | |

FOREIGN PATENT DOCUMENTS 2 576 045 7/1986 France .

OTHER PUBLICATIONS

H.A. McKenna Synthetic fibers can aid deepwater mooring:, Offshore, vol. 47, No. 11, Nov. 1987, Tulsa, OK, USA, pp. 35–36.

*Primary Examiner*—William Krynski
*Assistant Examiner*—J. M. Gray
*Attorney, Agent, or Firm*—Sughrue, Mion, Zinn, Macpeak & Seas, PLLC

[57] ABSTRACT

A new form of construction for synthetic cables used for the anchoring of floating platforms in offshore oil production is described. A desirable requisite for this application is that the durability of the cable is not affected by deterioration of its strong core by virtue of the aggressive mechanical action of particles of the sea bed which might penetrate the cable and reach its core. For this purpose a layer (2) to protect the core (1) comprising a strip of polymer material placed in helical fashion which permits the passage of water and prevents the passage of particles of the sea bed towards the core (1) is placed between the cable core (1) and its outer braided protective layer (2).

9 Claims, 2 Drawing Sheets

SYNTHETIC CABLE PROVIDED WITH PROTECTION AGAINST SOIL INGRESS

SCOPE OF THE INVENTION

This invention relates to the internal composition and manufacture of synthetic cables used to anchor floating platforms designed for offshore oil production. More specifically, the invention relates to a new construction concept for synthetic anchor cables, which are particularly advantageous for use in deep water, and their corresponding manufacturing process. The new cables are provided with a layer protecting their internal nucleus, normally referred to as the core, against the action of soil from the sea floor and of other damaging agents.

BASIS OF THE INVENTION

Cables manufactured of synthetic materials as a replacement for the ordinary steel cables or chains previously used are currently being specified for anchoring floating oil drilling, production, storage and transfer units in deep water. This is due mainly to the advantages which synthetic cables offer in respect of reduced radiuses and the cost of the anchoring system, and the reduced vertical force imposed by anchorage lines on the floating unit. Reducing the radius of anchoring systems is of growing importance in deep water oil production, to reduce the congestion on the sea bed caused by equipment which tends to occur with this type of operation. Similarly, when depths increase, the immersed weight supported by anchorage systems based on steel cables, of the order of 20 to 50 kg/m, or chains, of the order of 100 to 300 kg/m, can increase the cost of manufacturing floating structures excessively. Synthetic cables weighing of the order of 3 to 6 kg/m used in anchoring systems can be manufactured using some types of synthetic fibre, such as for example polyester, nylon, polypropylene, aramides or ultra high molecular weight polyethylenes. They basically comprise an inner core of fibres arranged parallel to or in a manufactured pattern in which the fibres make small angles with the axis of the cable, taking up the entire load, and a braided layer without a structural function which only provides protection for the nucleus. The inner nucleus is also known as the core. These cables are of an external diameter which typically lies between 100 and 200 mm, with a tensile strength of about 500 MPa. The core may be formed of a large and variable number of fibres, which may reach a total of the order of 20 million filaments. The thickness of the external braided layer is of the order of 10 mm.

The life of synthetic cables is affected by loading conditions and by various other factors which may be classified into three principal groups: environmental effects, surface wear effects, and those due to other mechanical stresses. The purpose of the invention is to increase the life of these cables by reducing the internal abrasion produced by the ingress of foreign material, and the occurrence of cyclic stresses.

In many situations it is advantageous for reasons of an operational order to have part of the anchorage system installed even before the floating unit arrives at its selected operating location. In such situations a natural and economic arrangement would be to leave the synthetic anchoring cables supported on the sea bed for the time between preinstallation and arrival of the floating unit for connection to the preestablished anchoring system. Nevertheless, the possibility of soil particle ingress within cables through the braided protective layer, giving rise to possible deterioration in the capacity of the core to withstand static and dynamic loads, has prevented these cables from being left in contact with the sea bed, as would be desirable. These soil particles mechanically wear away the core material through abrasion effects and can seriously affect its ability to withstand envisaged forces.

This invention relates to means applied to synthetic cables to prevent contact between soil particles which might pass through the braided layer and the core material, or penetration by these particles into the core, without affecting any of the main desirable characteristics of these cables such as weight and cost.

STATE OF THE ART

A possible way of avoiding soil particle ingress into cables would be to apply a sealing layer above the external braided layer of the cable, for example in the form of a continuous polyethylene jacket, or through the application of polyurethane elastomer. These solutions have already been tested and it has been found that they have disadvantages, such as:

- a difference in extension between the jacket and the cable, due to the difference between the elasticities of the materials, so that the jacket becomes detached from the cable,
- in the event of damage to the jacket, there is a localized concentration of stresses in the cable body giving rise to a reduction in cable strength,
- hydrostatic pressure on the cable, if the protective coating is impermeable, and
- difficulty for the cable to exchange heat generated by hysteresis when subjected to cyclic loading, given that there is yet another thick insulating layer between the cable and the water.

As far as economic and manufacturing aspects are concerned the following disadvantages may also be mentioned:

- the additional cost of the cable, resulting from the cost of the layer, and
- the difficulty of applying polyurethane elastomer coating to long lengths of cable.

U.S. Pat. No. 4,640,212 of Mar. 2, 1987 discloses an elastomer cable which has the property of becoming progressively more rigid as elongation increases. This comprises a solid core of elastomer material surrounded by a solid helically wound reinforcing strip manufactured of a material which is considerably less elongatable than the core material, and an outer covering layer also manufactured of solid elastomer material. The progressive increase in cable strength is achieved because the reinforcing layer is helically wound onto the core, forming an angle with the longitudinal axis of the cable within the range from 50 to 65. The reinforcement may optionally be formed of two helically wound layers having the same angle, but proceeding in opposite directions. Preferably the core is of synthetic rubber, the reinforcing layer has a structural function and the outer layer is not braided, unlike synthetic fibre cables. As for the use of this type of cable, it must be borne in mind that although the core is protected, it is very heavy and expensive for application in the anchoring of deepwater platforms. In reality, this core, through being solid, does not require protection against soil particle ingress. It should also be borne in mind that the American patent refers to a product which reduces the movement of the floating body by amounts very much greater (by from 40 to 100%) than those which are acceptable (from 1 to 20%) in most of the applications for which this invention is suitable.

The purpose of the invention according to this description is to provide protection for the core of synthetic cable without incurring the above-mentioned disadvantages.

SUMMARY OF THE INVENTION

The invention described here consists of the application of a coating in the form of a non-rigid polymer strip applied in helical form to the core of a synthetic cable and beneath its outer braided layer. The purpose of this protective layer is to prevent particles from the sea bed reaching the cable core, causing deterioration. If the polymer is impermeable, application should be such that a watertight layer does not form over the core, to avoid the occurrence of hydrostatic pressure on it.

Accordingly, the present invention provides a synthetic cable as defined in claim 1 and a process for manufacturing a synthetic cable as defined in claim 6.

DETAILED DESCRIPTION OF A PREFERRED EMBODIMENT OF THE INVENTION

The invention comprises an improved synthetic cable for, among other applications, anchoring floating structures for the production, storage and transfer of oil in deep water. Its purpose is to increase the durability of these cables, impeding the effect of deterioration of the core material caused by contact between it and aggressive substances contained in particles from the sea bed which infiltrate through the outer braided protective layer.

For a better understanding of the invention it will be presented with reference to the Figures accompanying this description. It should however be pointed out that the Figures illustrate only one preferred embodiment of the invention, and are not therefore of a restrictive nature. In compliance with the concept of the invention described below it will be dear to those skilled in the art that it will be possible to use different materials, formats or arrangements, a fact which is included in the scope of the invention.

Figure 1:
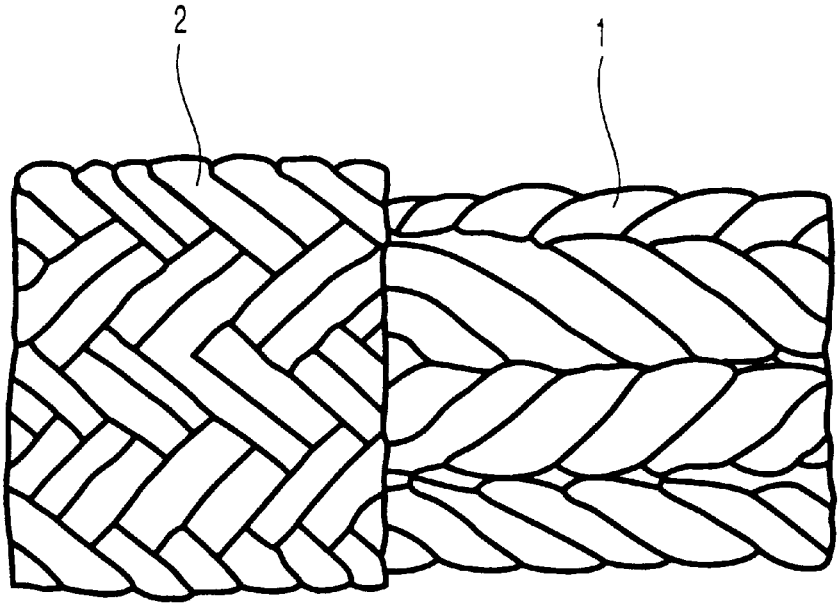
FIG. 1 presents a diagrammatic cut-away side view showing a construction of a synthetic cable as currently manufactured.

As may be seen in FIG. 1, synthetic anchorage cables comprise a nucleus (1), also referred to as a core, which is responsible for withstanding tensile forces imposed on the cable, and which is surrounded by an outer braided layer (2). It is desirable that these cables should have great resistance to tensile forces and a low unit weight. The core (1) is normally manufactured of nylon or polyester, in constructions of the steel cable type, as parallel wires or parallel strands. The core diameter is typically only slightly smaller than the final external diameter which is usually between 100 and 200 mm. Protecting core (1) has an outer braided layer (2) which is normally manufactured using the same material as the cable, which has a thickness of the order of 10 mm. The function of this layer (2) is to provide mechanical protection for core (1), mainly against damage which may occur during launching or recovery of the anchoring system. On these occasions the cable is subjected to wear and other adverse mechanical effects through being wound on drums and passed through pulleys or other items of handling equipment. This layer (2) is also necessary because of possible ship collisions with the cables, and also to perform the function of providing protection against environmental effects. When a length of cable comes into contact with the sea bed, which happens when the preinstalled anchoring system is temporarily on the sea bed awaiting arrival of the floating unit, the possibility of soil particle ingress into the cable increases. It should also be borne in mind that with use there is some deformation of braided layer (2), facilitating soil ingress, particularly when the cable is moved over the sea bed. As already mentioned, this is a cause of premature deterioration of cable core (1) and consequent loss of its ability to withstand envisaged forces.

Figure 2:
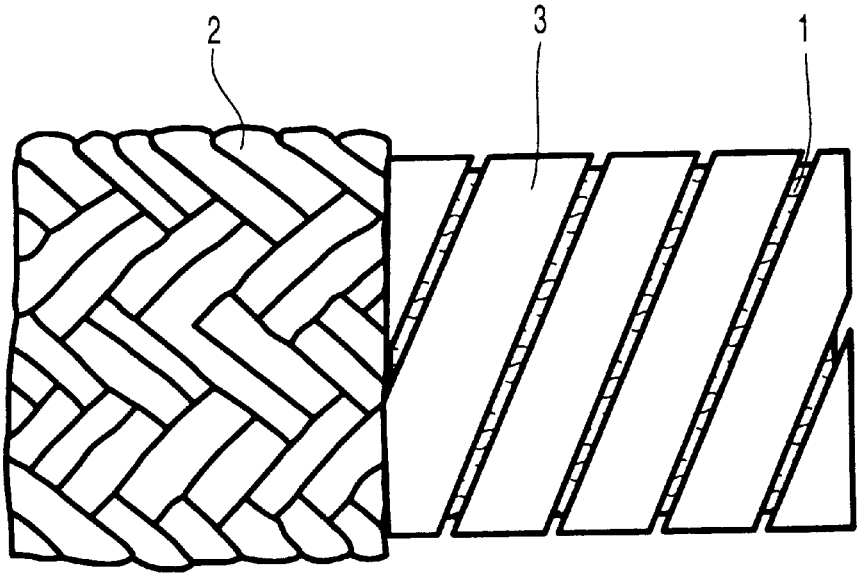
FIG. 2 presents a diagrammatic cut-away side view showing a synthetic cable manufactured as proposed in this invention.

FIG. 2 illustrates the solution described in this invention to overcome the above-mentioned disadvantage. The application of a coating in the form of a strip of polymer material which is helically wound forming an additional layer (3) between core (1) and braided outer layer (2) is proposed. In this way only core (1) of the cable is protected more effectively without prejudicing its performance. The strip of polymer material may be for example a strip of polyethylene having an approximate thickness of 0.1 mm and a width of 100 mm. As this material is impermeable, the polyethylene strip should be applied in such a way that a watertight layer over the core is not formed. A slight amount of overlap may be accepted when the strip is applied provided that this does not cause the layer to be watertight. Another possibility is to leave a small gap on the core surface which is not covered by the strip between two adjacent turns. A spacing of the order of 5 mm, corresponding to 5% of the width, is considered to be reasonable for the above-mentioned gap width, but this will depend on the cables envisaged depth class and may be determined more precisely by means of specific tests. In this way flow of water into core (1) is not in any way impeded, avoiding the generation of undesired hydrostatic pressures upon it, which would happen if the core was completely insulated from the environment.

Another alternative for the material of the core protection layer would be use of a porous polymer so that seawater would be able to pass through the polymer layer, leaving soil particles behind. In this case there is no need for any spacing between the turns of strip, and there is normally a slight overlap. Water naturally penetrates core (1) through this material, avoiding the possibility of generating hydrostatic pressures. The soil particles, which are of larger diameter than those of the pores in the polymer, are prevented from reaching the core.

Normally the conventional process of manufacturing these cables takes place in two stages.

First the core of the cable is manufactured.

In a second stage the outer protective layer is braided onto the core.

A mechanical system moves the core storage reel, drawing out the core in a coordinated way, and at the same time the protective layer is braided onto the core, completing manufacture of the cable, which is then wound onto the cable storage reel.

Figure 3:
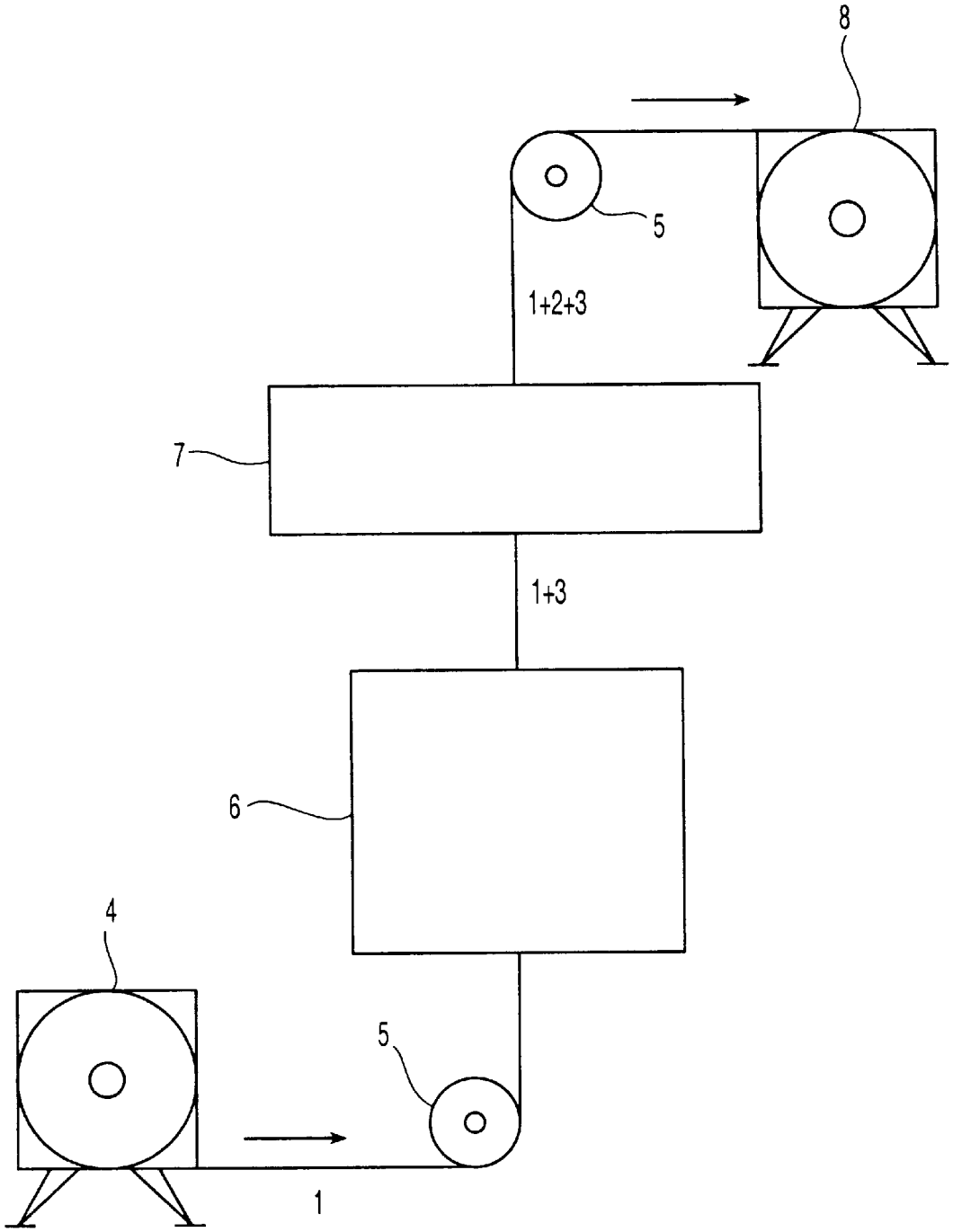
FIG. 3 presents a schematic view of the manufacturing process used to produce a cable according to the present invention.

In accordance with the cable design according to this invention, during this second stage of the manufacturing process, a strip of polymer material may additionally be applied to core (1) before the outer layer (2) is braided. As can be seen in FIG. 3, this is achieved by fitting a device known as a strip winder (6) before the braiding machine (7). This device is capable of effecting circular orbiting movements around core (1) in a plane perpendicular to the axis of movement of the cable. The speed of longitudinal movement of the cable and circular translation of the strip winding device (6) are coordinated to form a helix of strip on core (1)

with an appropriate pitch. In this case a cable which has already been provided with a protective layer (3) for core (1) and an outer braided protective layer (2) is manufactured. The core (1) is stored on a reel (4) at the beginning of the production line and the manufactured cable is stored on another reel (8) at the end of the same line. A system comprising pulleys (5), motors and other auxiliary mechanical, electrical and electronic elements, not shown in the drawings, are placed along the production line wherever needed.

To sum up, the arrangement proposed by the invention has the following advantages:

quite low cost, flow of water into the cable is not impeded, avoiding problems arising from the pressure difference between the cable core (1) and the environment, the possibility of ingress by soil particles which might reach core (1) is restricted, and layer (3) of polymer material which protects core (1) remains protected from damage during installation or movement of the anchoring system by the cables outer braided layer.

What is claimed is:

1. A synthetic cable comprising:

a core (1) formed by a plurality of synthetic fibres;

a braided outer protective water permeable layer (2), characterised in that the cable further comprises a protective layer (3) formed from a strip wound helically around the core and underneath the braided outer protective layer (2), so that water is able to reach the core and soil particles are impeded in their passage to the core (1).

2. A synthetic cable according to claim 1 wherein the strip is wound so as to leave a gap between adjacent turns.

3. A synthetic cable according to claim 2 wherein the helically wound strip is formed from a polymer material.

4. A synthetic cable according to claim 1 wherein the strip is wound so that adjacent turns overlap.

5. A synthetic cable according to claim 4 wherein the helically wound strip is formed from a water permeable material.

6. A process for manufacturing a synthetic cable comprising the steps of:

manufacturing a core (1);

providing said core (1) with a helically wound protective water permeable layer (3); and providing said protective layer (3) with a braided outer protective layer (2).

7. A process according to claim 6 wherein the core (1) is drawn from a reel in a controlled way and the helically wound protective layer (3) is fitted by a strip winding device (6) which is capable of circular orbiting movement around the core (1) in a plane perpendicular to the axis of the core (1), the longitudinal speed of movement of the core (1) and the circular orbiting of the strip winding device (6) being coordinated to form a helix of strip on the cable core having a defined pitch.

8. A process according to claim 7 wherein a braiding machine (7) is provided after the strip winding device (6) and is operated in coordination with the linear speed of movement of the cable so as to weave an outer protective layer on the cable (2).

9. A process according to claim 6 wherein the core manufacturing stage, the stage of fitting the helical protective layer and the stage of fitting the braided protective layer are arranged so as to form a continuous manufacturing line which includes in sequence the equipment necessary for the manufacture of the cable.

* * * * *